US009957090B2

(12) United States Patent
Weisshaupt et al.

(10) Patent No.: US 9,957,090 B2
(45) Date of Patent: May 1, 2018

(54) SECURITY SEAL FOR MEDICAL STERILE CONTAINER

(71) Applicant: Aesculap AG, Tuttlingen (DE)

(72) Inventors: Dieter Weisshaupt, Immendingen (DE); Gerold Zieris, Mülheim (DE)

(73) Assignee: Aesculap AG (DE)

( * ) Notice: Subject to any disclaimer, the term of this patent is extended or adjusted under 35 U.S.C. 154(b) by 0 days. days.

(21) Appl. No.: 15/039,447

(22) PCT Filed: Jun. 2, 2014

(86) PCT No.: PCT/EP2014/061394
§ 371 (c)(1),
(2) Date: May 26, 2016

(87) PCT Pub. No.: WO2015/082086
PCT Pub. Date: Jun. 11, 2015

(65) Prior Publication Data

US 2017/0001770 A1 Jan. 5, 2017

(30) Foreign Application Priority Data

Dec. 2, 2013 (EP) ..... 002363317

(51) Int. Cl.
*E05B 39/02* (2006.01)
*G09F 3/03* (2006.01)
(Continued)

(52) U.S. Cl.
CPC ..... *B65D 45/322* (2013.01); *B65D 43/00* (2013.01); *E05C 1/10* (2013.01); *E05C 19/10* (2013.01);
(Continued)

(58) Field of Classification Search
CPC ..... E05B 67/365; B65D 45/322; B65D 43/00; B65D 50/06; E05C 19/10;
(Continued)

(56) References Cited

U.S. PATENT DOCUMENTS 3,990,131 A * 11/1976 Okamura ..... A44B 99/005 24/287
4,040,279 A * 8/1977 Signorelli ..... E05B 67/365 70/34
(Continued)

FOREIGN PATENT DOCUMENTS

CN 101316769 A 12/2008
CN 102498044 A 6/2012
(Continued)

OTHER PUBLICATIONS

International Search Report and Written Opinion issued in related International Application No. PCT/EP2014/061394, dated Jul. 10, 2014.
(Continued)

*Primary Examiner* — Kristina R Fulton
*Assistant Examiner* — Faria F Ahmad
(74) *Attorney, Agent, or Firm* — RatnerPrestia

(57) ABSTRACT

A security seal for a medical container includes a seal foot having at least one latch structure movable relative thereto for engaging a mating latch structure formed on the container, and a seal head connected with the seal foot that includes at least one locking tab which is movably connected with the seal head through a hinge element, wherein the security seal includes a bolt element which can be positioned between a release position, in which the latch structure can be moved relative to the seal foot, and a locked position, in which the deformable latch structure is fixed in position relative to the seal foot and/or seal head.

15 Claims, 7 Drawing Sheets

Figure 1:
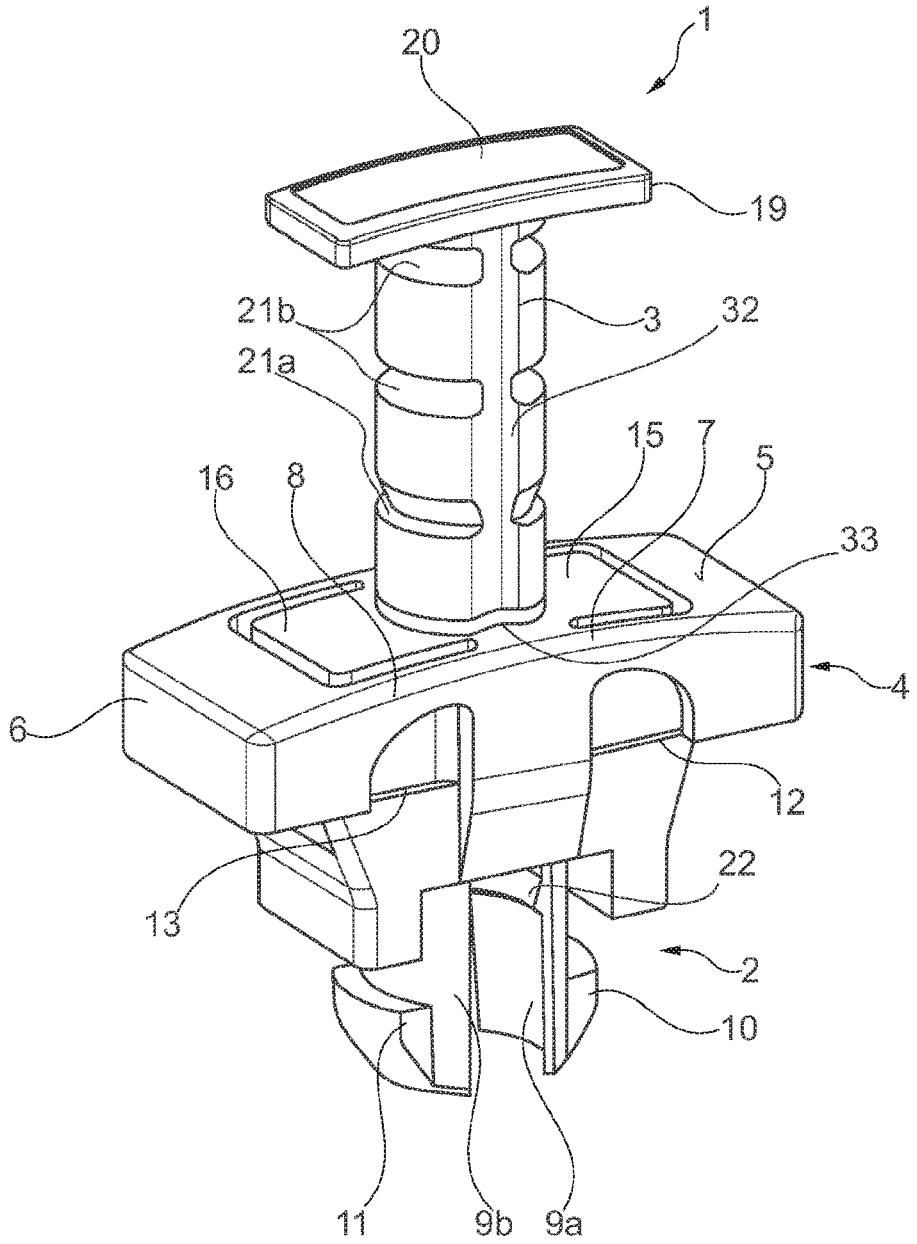

(51) Int. Cl.

| | |
|---|---|
| ***B65D 45/32*** | (2006.01) |
| ***B65D 43/00*** | (2006.01) |
| ***E05C 1/10*** | (2006.01) |
| ***E05C 19/10*** | (2006.01) |
| *E05C 19/00* | (2006.01) |
| *B65D 27/30* | (2006.01) |
| *B65D 33/34* | (2006.01) |
| *B65D 55/06* | (2006.01) |

(52) U.S. Cl.
CPC ..... *G09F 3/0317* (2013.01); *G09F 3/0364* (2013.01)

(58) Field of Classification Search
CPC ..... Y10T 24/44692; Y10T 24/44709; Y10T 24/45262; Y10T 24/45602; F16B 19/1081
USPC ..... 292/329, 300, 302, 303, 321, DIG. 11, 292/DIG. 12, DIG. 34, 327; 220/257.1, 220/256.1, 326, 324, 315, 323, 834, 833, 220/810; 411/508, 509, 45–48
See application file for complete search history.

(56) References Cited

U.S. PATENT DOCUMENTS 4,516,684 A * 5/1985 Walter ..... B65D 45/322 215/272
4,527,821 A * 7/1985 Tanaka ..... E05C 19/06 24/297
4,915,913 A 4/1990 Williams
5,028,187 A * 7/1991 Sato ..... F16B 19/1081 411/41
5,123,686 A * 6/1992 Wenk ..... B65D 63/1072 24/16 PB
5,651,652 A * 7/1997 Williams ..... B65D 55/06 411/508
5,671,513 A * 9/1997 Kawahara ..... F16B 21/06 24/581.11
5,975,369 A * 11/1999 Yurkewicz ..... B65D 41/32 215/251
6,182,482 B1 * 2/2001 Issitt ..... A01M 25/004 292/116
6,322,114 B1 * 11/2001 Kurachi ..... E05B 77/06 292/303
6,616,479 B1 * 9/2003 Jones ..... F16B 19/1081 411/48
6,827,536 B1 * 12/2004 Leon ..... F16B 5/0642 411/45
6,986,535 B2 * 1/2006 Kawamoto ..... E05C 19/022 200/524
7,021,826 B2 4/2006 Benjamins
7,165,790 B2 * 1/2007 Bella ..... E05C 19/022 292/302
7,207,758 B2 * 4/2007 Leon ..... F16B 21/02 411/45
7,246,828 B2 * 7/2007 Kitzis ..... B65F 1/1615 292/253
8,070,403 B2 * 12/2011 Tedeschi ..... E05D 5/121 411/2
8,221,042 B2 * 7/2012 Vitali ..... F16B 21/086 411/510
8,353,397 B2 * 1/2013 Trapp ..... B65D 73/0014 206/1.5
8,496,420 B2 * 7/2013 Aoki ..... F16B 5/0642 411/45
8,622,680 B1 * 1/2014 Diep ..... F16B 5/065 411/508
8,793,845 B2 * 8/2014 Benedetti ..... F16B 5/065 24/292
9,115,743 B2 * 8/2015 Yamamoto ..... F16B 21/065
D757,258 S * 5/2016 Weiβhaupt ..... D24/127
2004/0104230 A1 6/2004 Lorenz
2005/0056645 A1 * 3/2005 Buckley ..... B65D 39/08 220/257.1
2005/0224499 A1 * 10/2005 Jorgensen ..... B65D 43/0212 220/315
2007/0186389 A1 * 8/2007 Smith ..... F16B 5/0657 24/297
2007/0216139 A1 * 9/2007 Mazanek ..... B60R 21/04 280/728.2
2008/0193250 A1 * 8/2008 Boubtane ..... F16B 13/025 411/48
2008/0217337 A1 * 9/2008 Rault ..... B65D 43/165 220/266
2008/0237232 A1 * 10/2008 Cohn ..... B65D 33/25 220/210
2008/0275406 A1 * 11/2008 Smith ..... A61B 17/3462 604/256
2010/0032432 A1 * 2/2010 Stull, Sr. ..... B65D 51/1616 220/257.1
2010/0050401 A1 * 3/2010 Komeno ..... B60R 11/00 24/595.1
2011/0250104 A1 10/2011 Martel
2011/0253579 A1 10/2011 Chong
2012/0160850 A1 * 6/2012 Gelibert ..... B65D 55/063 220/320
2012/0291240 A1 * 11/2012 Suzuki ..... B60R 13/0206 24/633
2013/0091669 A1 4/2013 Sasaki
2013/0175276 A1 7/2013 Gleichauf et al.
2013/0287517 A1 10/2013 Fujiwara
2014/0050548 A1 * 2/2014 Loewe ..... F16B 5/0607 411/48
2014/0093325 A1 * 4/2014 Mizukoshi ..... F16B 13/063 411/45
2014/0319854 A1 * 10/2014 Lee ..... E05B 65/006 292/336.3
2015/0014315 A1 * 1/2015 Weisshaupt ..... G09F 3/0317 220/257.1
2016/0047406 A1 * 2/2016 Jamil ..... F16B 19/1081 411/48

FOREIGN PATENT DOCUMENTS

| | | |
|---|---|---|
| DE | 9405787 | 6/1994 |
| DE | 4411970 | 10/1995 |
| DE | 60101044 | 7/2004 |
| DE | 102007051428 | 4/2009 |
| DE | 102012004961 | 9/2013 |
| EP | 2053582 | 4/2009 |
| FR | 2714991 | 7/1995 |
| JP | 2013539999 A | 10/2013 |

OTHER PUBLICATIONS

Chinese Office Action with English language translation for Application No. 201480065235.7, dated Dec. 20, 2016, 51 pages.
Japanese Office Action with English language translation for Application No. 2016-555736, dated Dec. 21, 2016, 5 pages.
German Examination Report with English language translation for Application No. 11 2014 001 755.2, dated Aug. 3, 2017, 8 pages.

* cited by examiner

SECURITY SEAL FOR MEDICAL STERILE CONTAINER

RELATED APPLICATIONS

This application is the United States National Phase of International Application No. PCT/EP2014/061394, filed Jun. 2, 2014, which claims the benefit of priority of and is related to European Union Application No. EM 002363317, filed Dec. 2, 2013. The contents of International Application No. PCT/EP2014/061394 and European Union Application No. EM 002363317 are incorporated by reference herein in their entireties.

FIELD

The present invention relates to a security seal for a medical container, in particular a sterilization container or sterile container, comprising a seal foot having at least one latch structure movable relative thereto for engaging a mating latch structure formed on the container, and a seal head formed on the container or on a container closure and connected with the seal foot that comprises at least one locking tab which is movably connected with the seal head through a hinge element.

BACKGROUND

In the prior art, seals are used inter alia for the securing of closures. A simple and widely used example is represented by wire loops whose ends are connected with a sealing element, so that opening the seal without destroying the wire loop or seal is not possible. In the field of medical science, seals are used for instance with sterile containers in order to be able to check if such a sterile container has already been opened once after the sterilization and if instruments contained therein are still sterile. Various types of seals are known for this.

A very simple, known seal for sterile containers works according to the principle of a cable tie, i.e. a loop made of plastics, which is put through eyes provided on a container lid and a container trough and then closed. A proximal end of the seal is provided with indentations whose flanks pointing toward the proximal end are slanted, while the flanks pointing toward the distal end are set with a steep angle. The other, distal end of the seal is provided with a head having a through-hole into which an elastic latching nose projects. The seal is closed by inserting its proximal end into the through-hole such that the latching nose latches in place in one of the indentations. Due to the steep flank angle and a corresponding configuration of the latching nose, it is easy to insert the proximal end of the seal into the through-hole, but pulling it out in the reverse direction is not possible. The seal may be provided with labeling fields or the like.

Such a seal can only be opened by destroying it, i.e. by severing it at a certain position. The problem is that they are not protected from willful manipulations. A thin object could be pushed into the head of the seal, deforming the flexible latching nose against the spring action and opening the seal without destroying it. Thereafter, it could even be reused, so that it is not able to fulfil its function of ensuring the original state. In the clinic field, there is the further problem that a properly opened seal, i.e. a destroyed seal, loosely hangs on the container and can fall off during opening the container. As the floor of a surgery room is usually not sterile, a seal which has fallen down cannot be picked up just like that. As it is quite common that several containers are used, it might happen that several seals fall to the floor and impair the safe standing, walking and hence the concentration of the staff.

Another security system for sterile containers is made up of a bendable card which is put from the side into a slit of the container, so that its free end comes to lie in front of the closure tab of the container lid. The inserted end of the card has cutouts which will be engaged by associated protrusions in the slit. This is why the card cannot be removed from the slit if the container is closed. During opening the closure tab, the card is bent and springs back into its original position behind the closure tab. If the closure tab is closed again, the card is situated behind the closure tab and not in front of it, being indicative of the container already having been opened already. A disadvantage of this safety system is that the mechanism allowing the replacement of the card for a successive sterilization procedure is relative complicated, hence expensive and prone to failure and has a negative effect on the sterilization result. What is more, also this safety means is not tamper-proof. With the help of a long, thin object, the card could be bent away prior to closing the closure tab again, so that it will be again situated in front of the closure tab.

A further problem of the previously known seals and safety mechanisms is that it is not readily possible to see at the first glance whether they are already devaluated or destroyed or not. For example with a seal in a looped shape, a destroyed seal can be threaded again into the eyes on the container and an inattentive user will not necessarily notice that the eye has been destroyed already and hence devaluated.

DE 10 2012 004 961 A1 discloses a security seal comprising a seal foot having at least one latching protrusion and a seal head connected with the seal foot and having at least one locking tab. Each of the locking tabs is movably connected with the seal head by means of at least one hinge element. The seal foot comprises latching protrusions elastically formed thereon, which engage correspondingly formed latch structures during attaching the seal on a container and fix the seal on the container. With such a seal, it is not necessarily ensured that the seal is in its correct position and has been undetachably attached on the container. By way of example, the seal may seemingly latch in place on the container or be locked on the latter if it is attached to it in a tilted fashion, without the latching protrusions of the seal indeed having undetachably engaged the latch structure. In this case, the container is only apparently sealed in the correct manner, but can be opened without the possibility of detecting the manipulation. Furthermore, a seal might be potentially used again after the first use, impairing the tamper protection of the system.

SUMMARY

In the light of the previously described prior art, the invention is based on the object to provide a security seal for a surgical container, in particular a sterile container, which ensures a correct and user-friendly attachment of the seal on the container and in which the seal indicates a manipulation, in particular the fact of the container having been opened. In the case of a legitimate opening of the container, it should be prevented that some parts of the seal or even the entire seal come loose from the container and fall off. The removal of the seal from the container shall only be possible if the sealed closure has already been opened. The possibility of closing the closure after a devaluation of the seal is to be reliably prevented. Further, the security seal is supposed to be reliably protected from any unintentional devaluation through any impacts other than opening the sealed closure. Finally, it should be possible to remove the security seal without a large effort and without much dexterity.

This object is achieved according to the present invention by a generic security seal as described herein, with the security seal comprising a bolt element which can be positioned between a release position in which the latch structure can be moved relative to the seal foot, and a locked position in which the latch structure is fixed in position and/or locked relative to the seal foot, in particular is received on the seal foot and/or seal head so as to be positionable.

The security seal according to the invention gives a user the possibility to attach and fix it to a corresponding seating on a medical container in a particularly easy manner. This is performed e.g. by inserting the seal with its seal foot into a dedicated seating on the container and/or a container closure. In doing so, the latch structure of the seal engages a mating latch structure of the container or its closure and thus is fixed in position and fastened. According to the invention, the latch structure is relatively movable during attaching the seal on the container and, when being attached on the container, can be moved from its rest position (substantially corresponding to the position in which it engages the mating latch structure) to a deformed position in which it can be moved past the mating latch structure. This is made possible because the bolt element is in its release position during attachment of the seal on the container and does not fix the latch structure in position. In the intended end position on the container, the seal is positioned relative thereto in such a manner that the latch structure and the mating latch structure are in superposition. Upon reaching the end position, the latch structure moves from the deformed position back to the non-deformed rest position (e.g. springs back), whereby the engagement with the mating latch structure is established.

If the seal is in the proper end position and the latch structure is interlocked with the mating latch structure, the bolt element can be transferred from its release position to the locked position. In a particularly advantageous embodiment, this is not possible until there is the correct engagement between the latch structure and the mating latch structure. Otherwise, if the latch structure has not returned to its non-deformed rest position, the bolt element can be blocked by the latch structure or other units of the seal which will be deformed together with it, and hence cannot be transferred to its locked position. This offers the possibility to comprehensibly show the user whether the seal is correctly attached and fixed on the container or not. If the latch structure and the mating latch structure are in correct engagement and if the latch structure is in its non-deformed original position again, the bolt element can be transferred to the locked position. In said locked position, it blocks the latch structure in the position where it is in engagement with the mating latch structure. Thus, removing the seal from the container is not possible if the bolt element is in the locked position. As an alternative, it is also possible that the engagement between the latch structure and the mating latch structure is only established in the course of transferring the bolt element to the locked position. This is the case if a rather plastic material is used for the seal foot or the entire seal.

The locking tab of the seal is intended and adapted to lock the container or a part of its closure if it is properly attached on the container, so that an opening process without impact, alteration or destruction of the locking tab is not possible and will be prevented. The closure may comprise two closure parts, with one of said closure parts being attached on a container lid and the other on a container base. For the purpose of opening the container, a closure part can be positioned relative to the container in any way, for instance can be shifted or swiveled as desired. If the seal is correctly attached on the container, the locking tab is in operative connection with a part of the container or of the container closure. Any process of opening the closure or container necessarily results in an actuation of the locking tab. Such an actuation may involve the locking tab deforming or breaking off entirely or in part, for instance. In any case, an actuation of the locking tab causes an alteration of the seal which can be perceived by a user. Specifically, the actuation of the locking tab may result in a relative movement of the locking tab with respect to the remainder of the security seal which is firmly connected to the container and cannot be released by a manipulation from outside, with the locking tab moving around the hinge element. It is preferred that there occurs a plastic deformation of the hinge element, which can be perceived by a user and is irreversible.

It is preferred that the latch structure can be moved from the rest position to the deformed position by elastic deformation. It may be arranged in particular on a spring arm or similar element which has corresponding spring characteristics. The spring arm may extend from the seal foot in the axial direction. It is especially preferred if the latch structure protrudes from the spring arm in radial direction, in particular radially outward. The security seal advantageously comprises several latch structures, for instance two, three, four or more radially opposing latch structures. These may be positioned in particular with identical angular distances relative to one another.

According to one embodiment, the bolt element is designed like a bolt. It may be arranged in particular so as to be positionable relative to the seal head and/or relative to the seal foot in the direction oft its longitudinal axis. A particularly compact seal and good guidance of the bolt element can be achieved if the bolt element is mounted on or in a through-hole formed in the seal head and/or seal foot.

It is particularly advantageous if the bolt element (with unused security seal) is connected to the seal head and/or the seal foot through predetermined breaking points. In this way, it can be held in particular in its axial position. This allows a user to readily see if the seal has already been used and is to dispose, or if it is an unused seal with which he can expect an unlimited functionality. In this context, an unused security seal means that the bolt element is in its release position. The predetermined breaking points are of such a design that they can be broken without large effort when the user actuates the bolt element, i.e. can be destroyed during transfer of the bolt element from the release position to the locked position. However, they are of sufficient stability to hold the bolt element in the release position, so that the security seal can be properly attached on the container in an especially simple manner.

At least one contact shoulder may be arranged on the bolt element, for instance by one or more circumferential widened features or pockets. During the transfer of the bolt element to the locked position, the contact shoulder engages a mating contact shoulder formed on the seal foot and/or seal head, likewise e.g. pockets or widened features, so that a movement of the bolt element from the locked position back to the release position is prevented. The contact shoulder preferably extends in radial direction. It may extend along the circumference preferably in continuous manner, so that a stable engagement with the mating contact shoulder can be achieved.

In the system according to the invention, the latch structure in the non-deformed state and when being attached to the container as intended, the security seal engages the mating latch structure in an undetachable manner and can be elastically deformed from the non-deformed state for arranging it as intended. For the purpose of properly attaching the security seal on the container, the latch structure can be deformed from the non-deformed state preferably in an elastically deformable manner.

BRIEF DESCRIPTION OF THE DRAWING FIGURES

Figure 2:
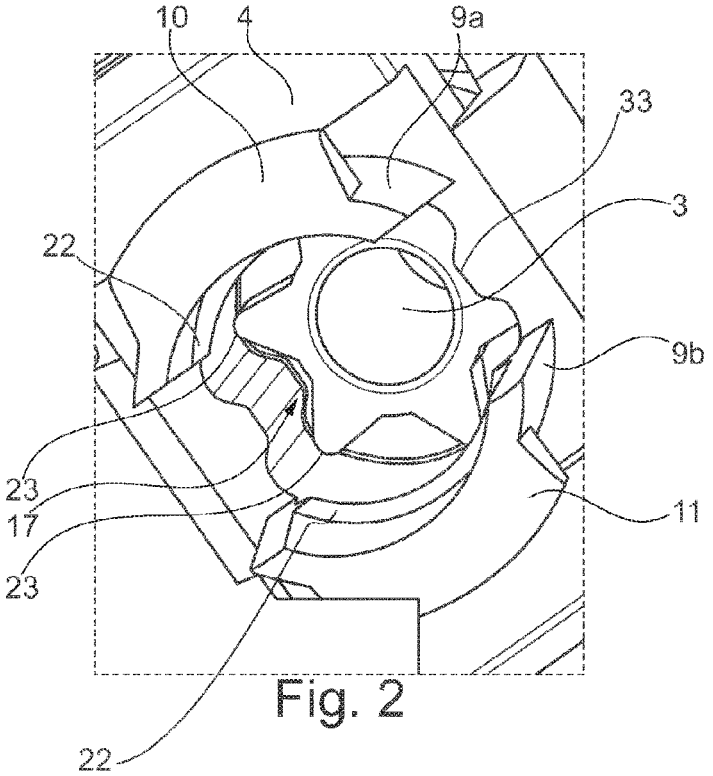
Figure 3:
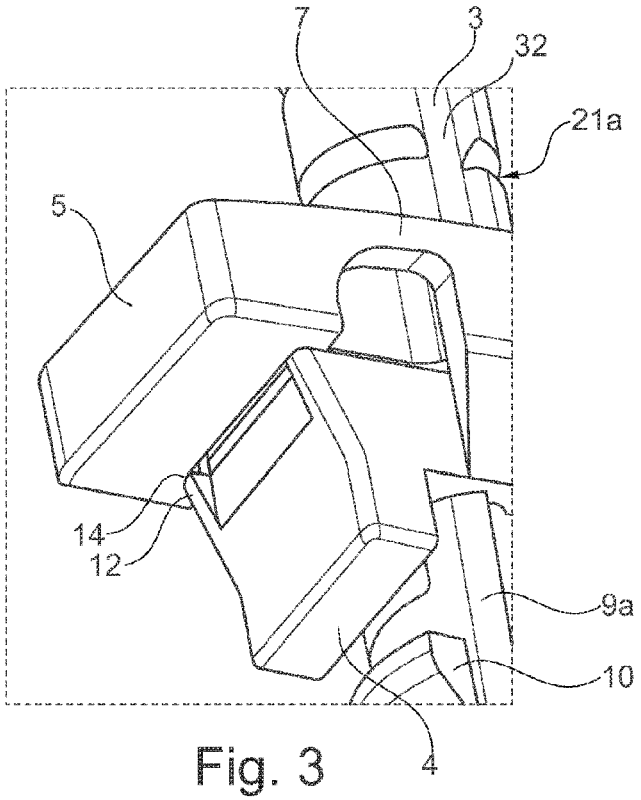
Figure 4:
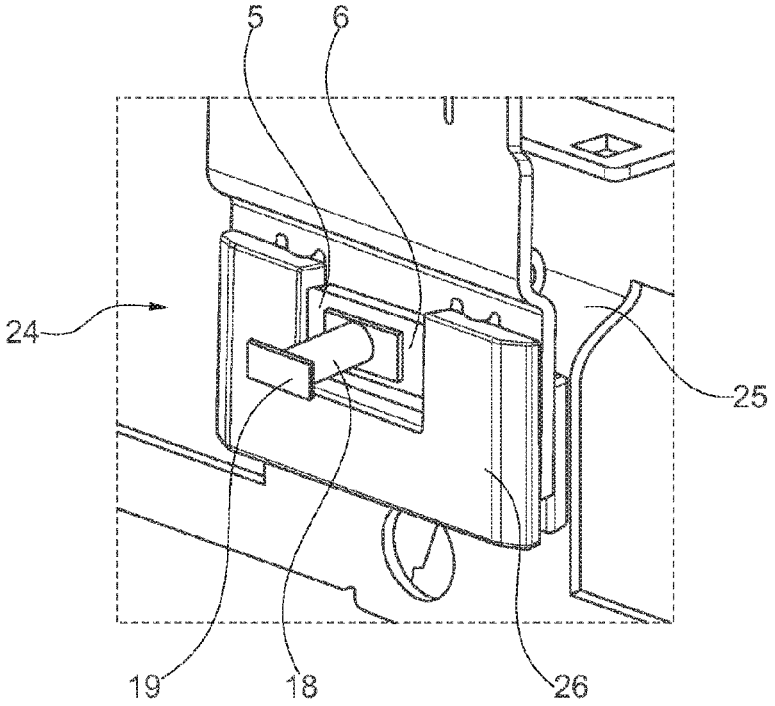
Figure 5:
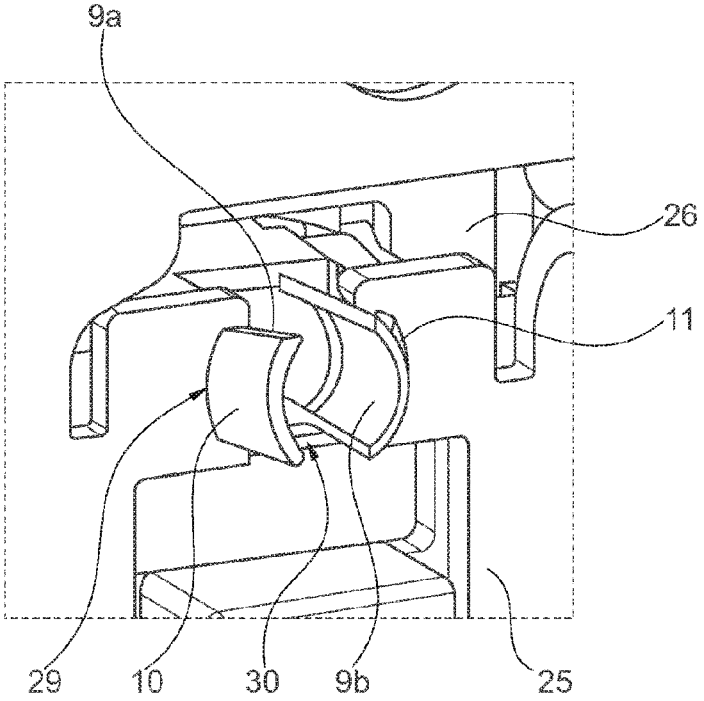
Figure 6:
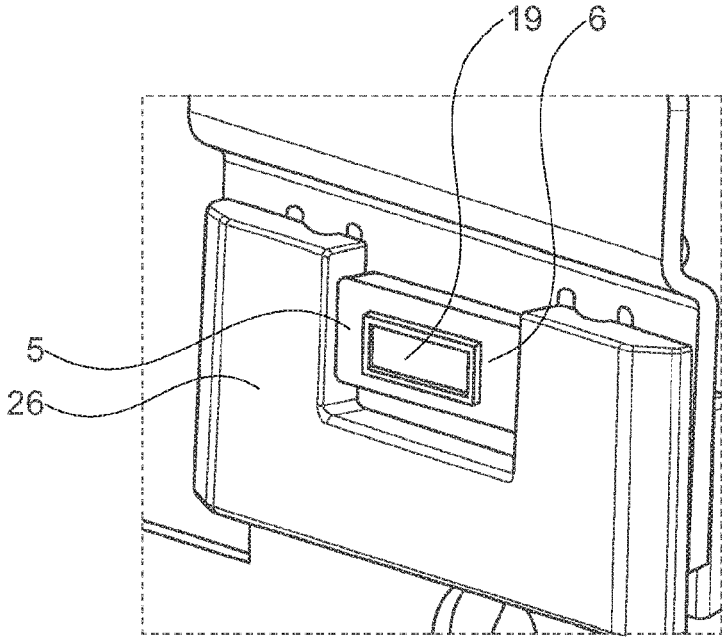
Figure 7:
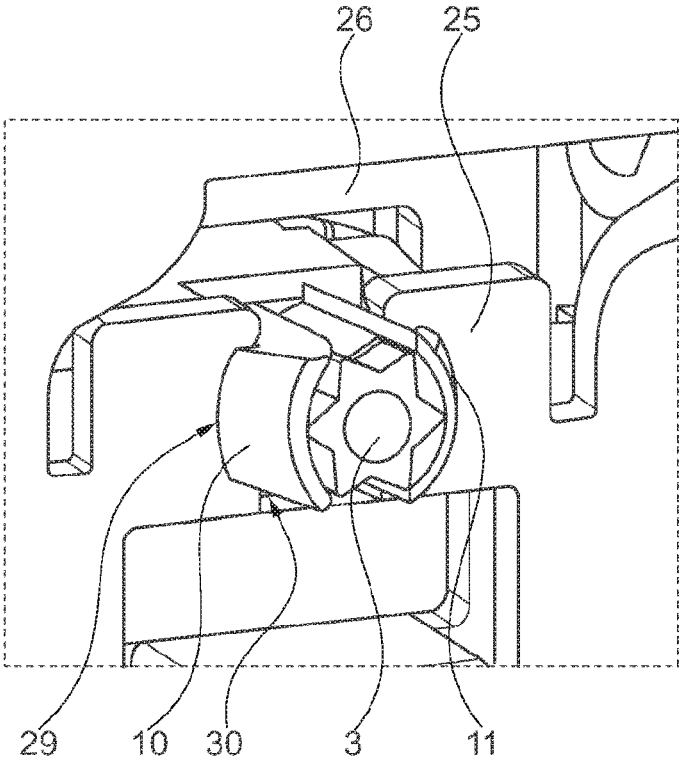
Figure 8:
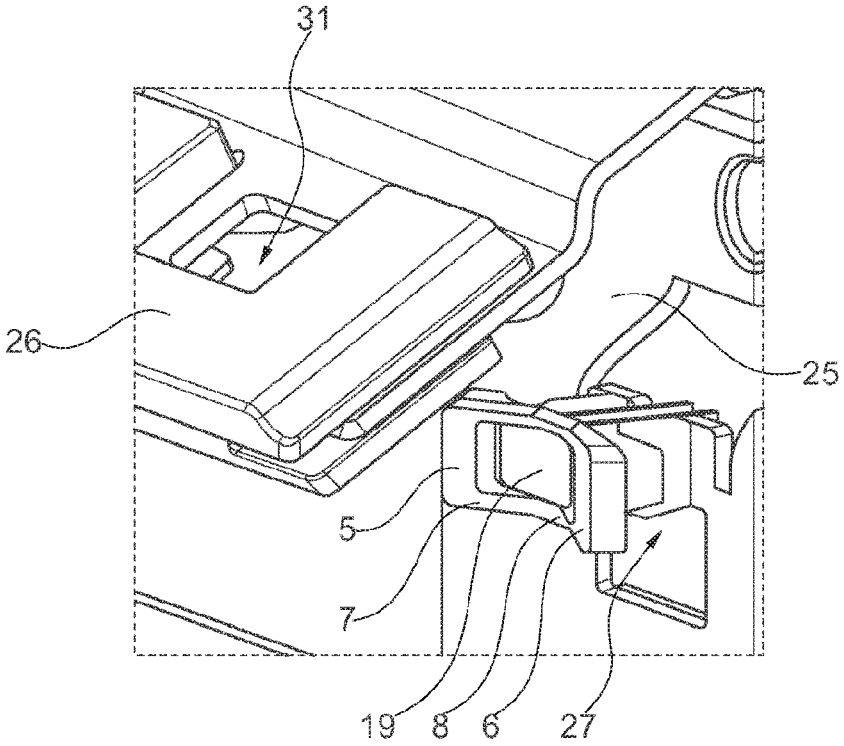
Figure 9:
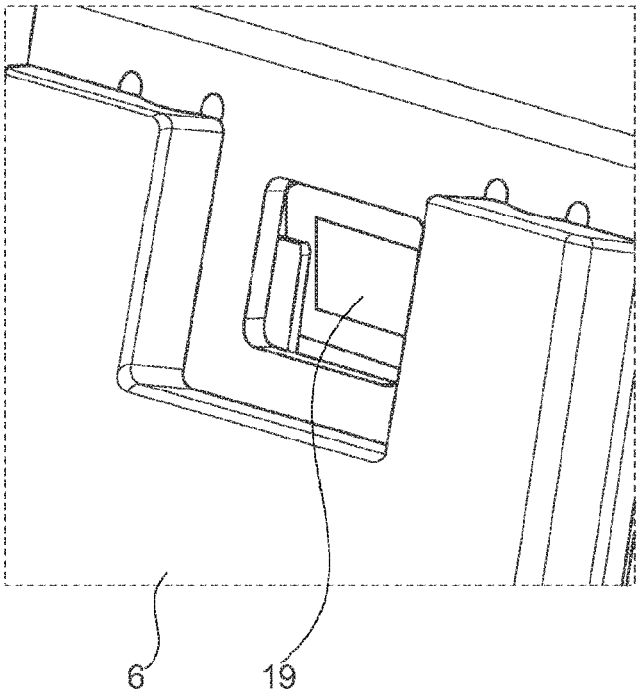
Figure 10:
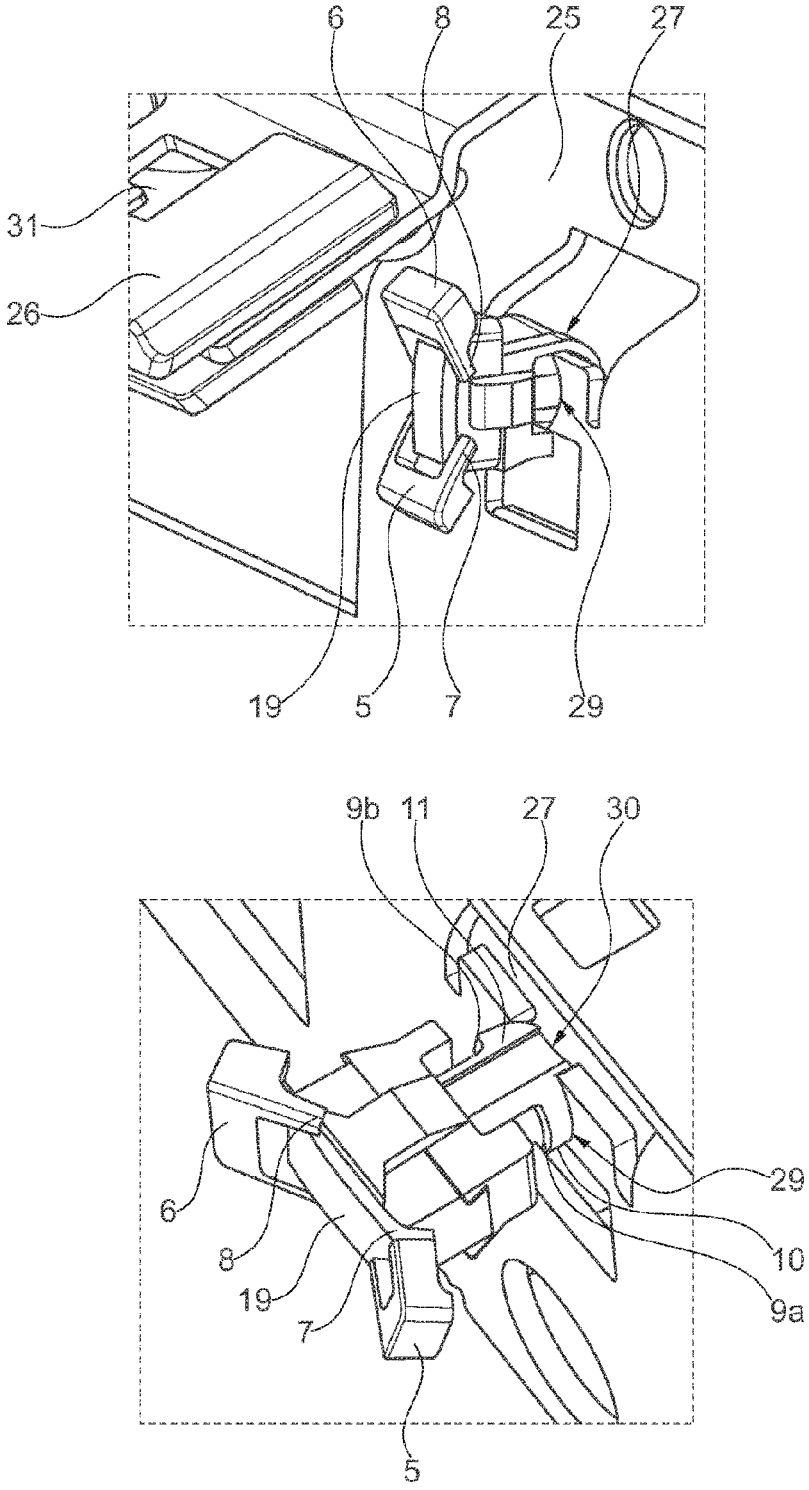
Figure 11:
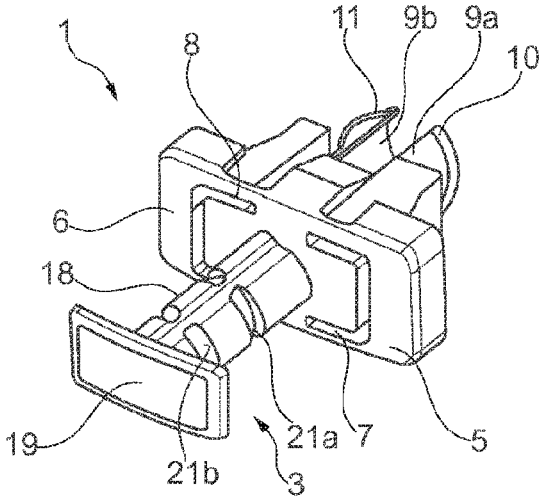
Figure 12:
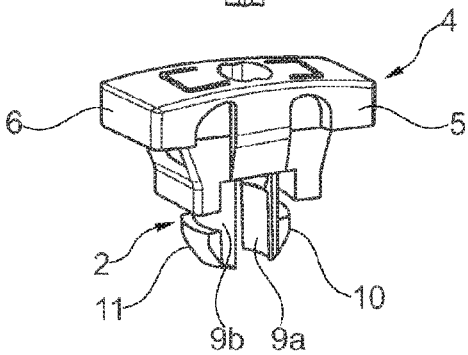
Figure 13:
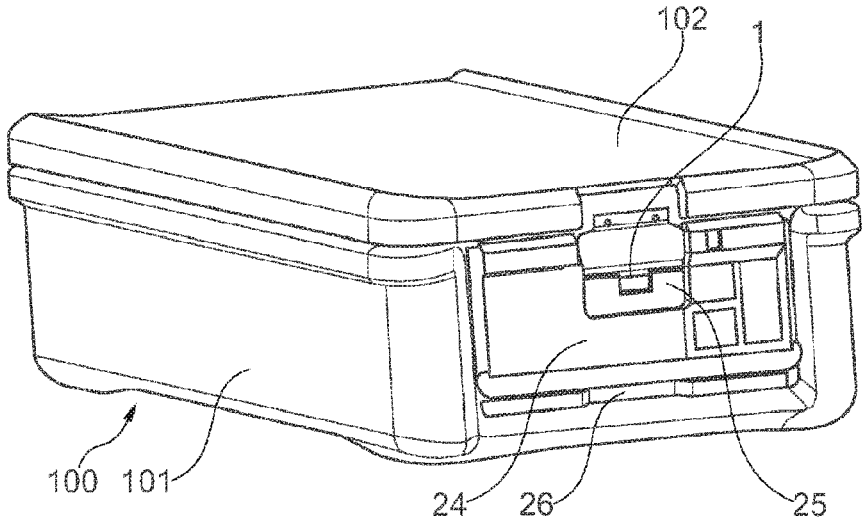

Further features and advantages of the present invention will be apparent from the following exemplary and non-limiting description of the invention as well as from a particularly preferred embodiment on the basis of Figures which are merely of schematic nature and only serve for the understanding of the invention. In the Figures:

FIG. 1 shows an embodiment of the security seal in a perspective illustration, FIG. 2 shows the embodiment of FIG. 1 in an enlarged perspective partial view, FIG. 3 shows the embodiment of FIG. 1 in another enlarged perspective partial view, FIG. 4 shows the security seal in the unlocked state, arranged on a sterile container, FIG. 5 shows the security seal in the unlocked state, arranged on a sterile container as seen from the seal foot, FIG. 6 shows the security seal in the locked state, arranged on a sterile container, FIG. 7 shows the security seal in the locked state, arranged on a sterile container as seen from the seal foot, FIG. 8 shows the security seal in the broken state, arranged on a sterile container after having opened the latter, FIG. 9 shows the security seal in the broken state, arranged on a sterile container after having opened the latter and during the attempt to close the container again, FIG. 10 shows the process of removing the security seal after having opened the containers at two successive points in time, FIG. 11 is a perspective view of a one-piece security seal, FIG. 12 is a perspective view of a two-piece security seal, and FIG. 13 shows a sterile container comprising a security seal according to the invention in a perspective view.

DETAILED DESCRIPTION

A security seal 1 according to the invention comprises a seal foot 2, a locking bolt 3 and a seal head 4. The entire security seal 1 is made of plastic in one piece by injection-molding. In FIGS. 1 to 5, the security seal 1 is shown in its original state, i.e. before sealing a container. The FIGS. 6 and 7 show the security seal 1 in a state when it is inserted in a sterilization container 100 to be sealed. FIGS. 8 and 9 show the security seal 1 after having opened the container 100 and FIG. 10 finally shows it during removal therefrom.

By means of two hinge elements 7, 8, two locking tabs 5, 6 are movably arranged on the seal head 4. The locking tabs 5, 6 are opposite each other in radial direction. In the embodiment illustrated, the security seal 1 is designed to be mirror-symmetric. The hinge elements 7, 8 are laterally formed on the seal head 4.

When the security seal 1 is opened, said hinge elements are deformed. If the hinge elements 7, 8 are bent beyond a certain amount, they are subject to a plastic deformation which results in irreversible changes of the material up to a so-called stress whitening. The degree of the banding or deformation as from which the plastic deformation and/or the stress whitening of the hinge elements 7, 8 occurs, depends on their dimensions, in particular on the height and width of the hinge elements 7, 8 as well as on the material properties.

The seal foot 2 comprises two spring arms 9*a, b* extending from the seal head 4. Each of said spring arms has its distal end provided with a latching protrusion 10, 11 which are opposite each other in radial direction and protrude radially outward. The latching protrusions 10, 11 protrude with respect to the seal foot 2 in the same directions as the locking tabs 5, 6 with respect to the seal head 4.

The seal head 4 has an essentially rectangular cross-section. The two locking tabs 5,6 and the associated hinge elements 7, 8 likewise result in a substantially rectangular cross-section. In addition, each locking tab 5, 6 protrudes radially with respect to the seal foot 2 and the seal head 4, Formed on the seal head 4 are two protrusions 12, 13 which project laterally from the seal head 4. They extend along the longer side of the substantially rectangular seal head 4 and each form a supporting area 14 which rests against the side of the locking tabs 5, 6 facing the seal foot 2. Here, a thin material connection may be present which protects the locking tabs 5, 6 from any unintentional actuation—for instance during transport or inserting it into the container—and breaks in case of a larger force—namely from the locking tab. This version is much easier to produce, as the process of demolding the seal 1 after injection-molding is considerably simplified.

Formed in the seal head 4 is a through-hole 17 which is illustrated in FIG. 2, for example. The through-hole 17 fully penetrates the seal head 4 in the axial direction and serves for receiving and guiding the locking bolt 3 so as to be positionable in the axial direction. Said locking bolt substantially consists of a bolt shaft 18 and a bolt head 19 which is arranged on the end of the bolt shaft 18 opposite the through-hole 17. The bolt head 19 is provided with a receiving pocket 20 for an indicator which is not shown.

The bolt shaft 18 is provided with pockets 21 which are spaced from each other in the axial direction and are incorporated in the radial direction in the bolt shaft 18 circumferentially surrounding it in part and so as to be discontinued by two axial grooves 32 which are described in more detail below. The pockets 21*a* which have the lowermost position in FIG. 1 (those which are closest to the seal foot 2) and are opposite each other serve as latch structures for latching protrusions 22 of the spring arms 9*a, b* explained below. As seen in cross-section, the lateral surface of said pockets 21*a* which faces the seal foot 2 is designed with a steep angle with respect to the longitudinal axis of the locking bolt 3, inclined with respect to the longitudinal axis at an angle between roughly 80° and 100°, preferably 90°. The opposite lateral surface may have a slight inclination. The lowermost pockets 21*a*, i.e. those which are ahead if the locking bolt 3 is inserted, serve for securing the locking bolt 3 in the fully inserted state or its end position. The pockets 21*b* which are further up in FIG. 1 or have a larger distance from the seal foot 2 are optional, however, and can cooperate with corresponding latch structures (not shown in more detail) in the seal head 4 and haptically indicate an "intermediate latching process". These pockets 21*b* preferably have a round cross-section and allow the locking bolt 3 to engage and disengage in both directions before reaching the final locking position.

As illustrated in particular in FIG. 2, the end of the locking bolt 3 facing the seal foot 2 has a star-shaped design. In the original state, i.e. when the security seal 1 is unused, the locking bolt 3 is held on the seal head 4 by means of material webs 23 which are formed between the tips of its star-shaped end and the wall of the through-hole 17. In other words, the security seal 1 is realized in one piece, in particular a one-piece injection-molded part. Such a one-piece seal 1 is shown in FIG. 11. The material webs 23 are implemented as predetermined breaking points which indeed hold and fix the locking bolt 3 in its original position with respect to the seal head 4; in the event of a user-side actuation in which the locking bolt 3 is axially shifted toward the seal foot 2, however, these material webs will break and release the locking bolt 3. As an alternative, the seal 1 may have a two-piece design, i.e. it may consist for instance of a separate seal body made up of seal head 4 and seal foot 2, on the one hand, and of a separate locking bolt 3 on the other hand. Such a security seal 1 is shown in FIG. 12.

It can be taken from FIG. 2 that the spring arms 9*a, b* having their distal ends provided with the latching protrusions 10, 11 are formed like a partial cylinder and arranged around the through-hole 17. This is why the locking bolt 3 can be inserted through the through-hole 17 into the gap between the spring arms 9*a, b*. Each of the spring arms 9*a, b* has its radially inner side provided with a latching protrusion or mating contact shoulder 22 which serves for engaging the corresponding pocket 21*a* during actuation of the seal, i.e. when the locking bolt 3 is inserted toward the seal foot 2. During inserting the locking bolt 3 into the through-hole 17, the former advances in the axial direction with a concomitant elastic expansion of the spring arms 9*a, b* in radial outward direction. If the pockets 21*a* reach the axial position of the latching protrusions 22, the spring arms 9*a, b* spring back due to their elasticity, and the latching protrusions 22 engage the pockets 21. This latching process can be perceived by the operator during locking the security seal 1. Due to the steep flank of the pockets 21*a* which is near the seal foot, pulling out the locking bolt 3 is not possible any longer as from this point in time, as the latching protrusions 22 cannot slide over the steep flanks and the locking bolt 3 is blocked in this direction by the engagement of the latching protrusions 22 in the pockets 21. The latching protrusions 22 latch in place in the pockets 21*a* only in the end position of the locking bolt 3. If the locking bolt 3 is inserted, a deformation of the spring arms 9*a, b* into the gap which is present between them is not possible, as the spring arms 9*a, b* have their inner surfaces abutting against the locking bolt 3.

The process of sealing a sterilization container 100 will be explained now with reference to FIGS. 4 to 7. The sterile container 100 comprises a container closure 24 which is substantially formed from a first closure part 25 and a second closure part 26. The second closure part 26 can be moved between an open position and a closed position relative to the first closure part 25, in particular can be swiveled. For the purpose of opening the sterile container 100, the first closure part 25 has to be swiveled away from the second closure part 26. If the closure 24 is closed, the two closure parts 25, 26 rest against each other more or less.

The first closure part 25 has a seating 27 where the spring arms 9*a, b* of the seal foot 2 can latch in place. FIG. 5 shows the spring arms 9*a, b* of a security seal 1 arranged on the sterile container 100, as seen from the container 100. The second closure part 26 comprises a through-hole 31 through which the spring arms 9*a, b* have to be put during insertion in the seating 27 of the first closure part 25.

The sterile container 100 is closed by means of the closure 24 and the two closure parts 25, 26 are swiveled relative to each other. The security seal 1 is arranged on the container 100 by inserting it from the outside toward the container 100 through the through-hole 31 into the seating 27. In doing so, the spring arms 9*a, b* pass through the seating 27 such that the latching protrusions 10, 11 engage behind its surrounding edge and fix the security seal 1 on the closure 24 and hence on the container 100. On the side of the container, the latching protrusions 10, 11 are each provided with a starting bevel 28 which can be clearly seen in FIG. 5. During arranging the seal 1 on the container 100, the starting bevel 28 comes into contact with the edge of the seating 27. The spring arms 9*a, b* are deflected radially inwards with a continued insertion of the seal toward the container 100 until the latching protrusions 10, 11 have moved past the edge of the seating 27, and then spring back in elastic fashion to their original position, engaging behind the edge. FIG. 5 shows the seal 1 in the state in which it is fully slipped onto the closure 24. As can be taken from FIG. 4, the locking bolt 3 is still in its original position at this point in time, i.e. a position in which it is not advanced into the through-hole 17 of the seal head 4, and is secured by means of the material webs 23.

In the further course of sealing the container 100, the locking bolt 3 is pushed into the seal head 4 toward the container 100 and the seal foot 2. Due to the pressure which is exerted on the bolt head 19 by the user, the material webs 23 realized as predetermined breaking points will break. The bolt shaft 18 is pushed through the through-hole 17 and reaches the gap between the two spring arms 9*a, b* which are in their original position after the latching of the latching protrusions 10, 11. During insertion of the locking bolt 3 into the through-hole 17, the latching protrusions 22 provided on the inner surfaces of the spring arms 9*a, b* slide over the bolt shaft 18 of the locking bolt 3, and the spring arms 9*a, b* are slightly deformed radially outwards. In the further course of the insertion process, they engage the pockets 21*a* on the bolt shaft 18. In the state fully inserted in the seal head 4, which is shown in FIGS. 6 and 7, the bolt head 19 rests flush on the seal head 4. The bolt shaft 18 inserted through the through-hole 17 between the spring arms 9*a, b* to such an extent that the tips of its star-shaped end structure rest against the inner surfaces of the spring arms 9*a, b* and prevent their radially inward deformation. As a result, the locking bolt 3 is blocked by the engagement of the protrusions 22 in the pockets 21*a*, whereas the spring arms 9*a, b* are blocked by the locking bolt in the position latched in place in the seating 27. Without opening the closure 24, the seal 1 cannot be detached from it and from the container 100. In order to prevent any unintentional axial twisting of the locking bolt 3 with respect to the through-hole 17, the bolt shaft 18 is provided with two axial grooves 32 and the through-hole 17 has two areas 33 which protrude radially inwards and engage the grooves 32 and guide the locking bolt 3 when the locking bolt 3 is inserted into the through-hole 17. At the very beginning of the insertion operation, the material webs 23 serve as anti-rotation means, too.

The seating 27 has such a design that it has areas, for example, in the form of its edges which are able to produce undercuts with the latching protrusions 22 of the seal foot 2. In this exemplary embodiment, these are two arcuate portions 29 (clearly visible in FIG. 10) which delimit the seating 27 laterally. Formed between the arcuate portions 29 are two open recesses 30, to be seen in FIG. 7. These have such a design that the latching protrusions 22 are able to move past the spring arms in both directions, i.e. toward the container 100 or away from the container 100. For the purpose of removing the security seal 1 from the seating 27, the container 100 or the closure 24 has to be opened first, whereby the seal 1 is devaluated. If the closure 24 is open, it can then be rotated in the seating 27 around its longitudinal axis, in particular by 90°, until the latching protrusions 22 overlap with the free recesses 30 and the security seal 1 can be pulled out of the seating 27.

If the security seal 1 is fully inserted (see FIGS. 6 and 7), the seal head 4 is situated in the through-hole 31 in form-locking fashion, so that the security seal 1 cannot be rotated with respect to the closure 24. As a consequence, the protrusions 22 cannot be removed from the recess 27 in the above-described manner without opening the closure 24. Moreover, the security seal 1 is completely embedded in the second closure part 26 and is flush with it, whereby it is protected against accidental damage.

The security seal 1 according to the invention is supposed to ensure that the safety closure 24 and hence the container 100 cannot be opened without devaluating the security seal 1. The devaluation of the security seal 1 is brought about in that its locking tabs 5, 6 are bent apart due to the contact with the second closure part 26 during opening the closure 24. This results in irreversible, preferably plastic deformation of the locking tabs 5, 6 and/or the hinge elements 7, 8 which has already been described above. The locking tabs 5, 6 are bent up so far until they fit through the through-hole 31 of the second closure element 26. With the locking tabs 5, 6 being bent open, the second closure part 26 moves past the seal head 4, so that the closure 24 can be opened with a concomitant devaluation of the security seal 1. This state is illustrated in FIG. 8. Any re-closing of the closure 24 is not possible without completely removing the security seal 1 from the container 100, as the bent-up locking tabs 5, 6 cannot be moved through the through-hole 31 in the opposite direction (see FIG. 9).

The security seal 1 according to the invention can be used in combination with a closure 24, for instance on a sterile container 100 as shown in FIG. 7 and comprising a container trough 101 and a lid 102. The first closure part 25 may be provided on the container trough 101 and the second closure part 26 on a closure tab which is articulated on the lid 102 of the container 100. The container 100 is of symmetric design and has its two end faces provided with one closure 24 each. For opening the container 100, i.e. for lifting off the lid 102 from the container trough 101, the two closure tabs articulated on the lid 102 are swiveled open, so that the second closure part 26 is moved away from the corresponding first closure part 25 in a pivoting manner.

The significant advantages of the security seal 1 according to the invention can be summarized as follows:

- The reuse of the security seal 1 after opening the sterile container is safely prevented.
- The bolt head 19 offers a large and clearly visible area for an indicator.
- The configuration allows a good visual check of the intactness of the seal.
- During locking of the seal, the operator feels when the locking bolt 3 locks in place.
- The security seal 1 can only be locked if it is in the correct position.
- The locking bolt 3 helps in the positioning and handling of the security seal 1.
- The security seal 1 is fully embedded in the front plate of the second closure part 26 and in this way is protected against accidental damage.
- The security seal 1 can be set and locked in a one-hand actuation.
- It is not possible to open the lid 102 without devaluating the security seal 1.
- Once devaluated, the security seal 1 is irreparable, as the locking bolt 3 is latched in place and all connections are destroyed.
- The security seal 1 does not fall off from the container 100 when the lid 102 has been removed.

The invention claimed is:

1. A security seal for a medical container, the security seal comprising:

a seal foot having a substantially circular cross-section and having at least one latch structure movable relative to the seal foot for engaging a mating latch structure formed on the medical container, and a seal head connected with the seal foot and comprising at least one locking tab which is movably connected with the seal head through a hinge element, the security seal comprising a bolt element which can be positioned between a release position, in which the at least one latch structure can be moved relative to the seal foot, and a locked position, in which the at least one latch structure is fixed in position relative to the seal foot, wherein the seal foot comprises at least two spring arms extending from the seal head, each of said at least two spring arms having a distal end provided with a latching protrusion, the latching protrusions protruding radially outwardly, wherein the at least two spring arms are each formed as a partial cylinder and arranged around a through-hole which is formed in the seal head and fully penetrates the seal head, the through-hole serving to receive and guide the bolt element.

2. The security seal according to claim 1, wherein the bolt element has a bolt-like design and is arranged so as to be able to be positioned in the direction of its longitudinal axis relative to at least one of the seal head and the seal foot.

3. The security seal according to claim 1, wherein the bolt element is supported on or in a through-hole formed in at least one of the seal head and seal foot.

4. The security seal according to claim 1, wherein the bolt element in its locked position fixes the at least one latch structure.

5. The security seal according to claim 1, wherein the bolt element is connected with at least one of the seal head and the seal foot in the release position via predetermined breaking points and is held in its axial position, said predetermined breaking points being destroyed when transferring the bolt element from the release position to the locked position.

6. The security seal according to claim 1, wherein at least one contact shoulder extending in a radial direction is formed on the bolt element, said at least one contact shoulder engaging a mating contact shoulder formed on at least one of the seal foot and the seal head during transfer of the bolt element to the locked position, so that any movement of the bolt element from the locked position back to the release position is prevented.

7. The security seal according to claim 1, wherein the at least one latch structure comprises the latching protrusions.

8. The security seal according to claim 1, wherein the at least one latch structure comprises a plurality of radially opposite latch structures which are positioned at equal angular distances.

9. A system comprising a medical container and a security seal according to claim 1.

10. The system according to claim 9, wherein when the at least one latch structure is in a non-deformed state and arranged on the container as intended, the security seal engages the mating latch structure in an undetachable manner and can be elastically deformed from the non-deformed state for arranging it as intended.

11. The security seal according to claim 1, wherein an end of the bolt element facing the seal foot has a star-shaped end structure comprising a plurality of tips, the tips of the star-shaped end structure resting against inner surfaces of the at least two spring arms and preventing radially inward deformation of the at least two spring arms in the locked position.

12. The security seal according to claim 1, wherein the bolt element comprises a bolt head and a bolt shaft, the bolt shaft beinq provided with a pocket incorporated in a radial direction in the bolt shaft, circumferentially surrounding the bolt shaft in part and discontinued by two axial grooves, and wherein each of the spring arms has its radially inner side provided with a latching protrusion which serves for engaging the pocket.

13. The security seal according to claim 1, wherein the bolt element comprises a bolt head and a bolt shaft, the bolt shaft being provided with a pocket incorporated in a radial direction in the bolt shaft, circumferentially surrounding the bolt shaft in part and discontinued by two axial grooves, and wherein the through-hole has two areas which protrude radially inwards and engage the axial grooves and guide the bolt element when the bolt element is inserted in the through-hole.

14. The security seal according to claim 1, wherein the bolt element comprises a bolt head and a bolt shaft, the bolt shaft being provided with a pocket incorporated in a radial direction in the bolt shaft, circumferentially surrounding the bolt shaft in part and discontinued by at least one axial groove.

15. A security seal for a medical container, the security seal comprising:

a seal foot having a substantially circular cross-section and having at least one latch structure movable relative to the seal foot for engaging a mating latch structure formed on the medical container, and a seal head connected with the seal foot and comprising at least one locking tab which is movably connected with the seal head through a hinge element, the security seal comprising a bolt element which can be positioned between a release position, in which the at least one latch structure can be moved relative to the seal foot, and a locked position, in which the at least one latch structure is fixed in position relative to the seal foot, wherein the bolt element comprises a bolt head and a bolt shaft, the bolt shaft being provided with a pocket incorporated in a radial direction in the bolt shaft, circumferentially surrounding the bolt shaft in part and discontinued by at least one axial groove.

* * * * *